US009658563B2

(12) United States Patent
Jang

(10) Patent No.: US 9,658,563 B2
(45) Date of Patent: May 23, 2017

(54) IMAGE FORMING APPARATUS, CONTROLLING METHOD OF THEREOF AND NON-TRANSITORY COMPUTER READABLE STORAGE MEDIUM

(71) Applicant: Samsung Electronics Co., Ltd., Suwon-si (KR)

(72) Inventor: Si-joong Jang, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/064,033

(22) Filed: Mar. 8, 2016

(65) Prior Publication Data

US 2017/0003617 A1 Jan. 5, 2017

(30) Foreign Application Priority Data

Jul. 2, 2015 (KR) ..... 10-2015-0094480

(51) Int. Cl.
*G03G 15/043* (2006.01)
*G03G 15/04* (2006.01)
*G03G 15/00* (2006.01)

(52) U.S. Cl.
CPC ..... *G03G 15/043* (2013.01); *G03G 15/04054* (2013.01); *G03G 15/5054* (2013.01)

(58) Field of Classification Search
CPC ..... G03G 15/043; G03G 15/04054
See application file for complete search history.

(56) References Cited

U.S. PATENT DOCUMENTS 5,444,525 A * 8/1995 Takahashi ..... G03G 15/326 101/211
5,917,535 A 6/1999 Corona
2002/0075372 A1 6/2002 Nagumo et al.
2010/0166444 A1* 7/2010 Nomura ..... B41J 2/451 399/51
2010/0172665 A1 7/2010 Nomura
2014/0146371 A1 5/2014 Hayashi et al.
2015/0261117 A1* 9/2015 Suzuki ..... G03G 15/043 347/118

FOREIGN PATENT DOCUMENTS

JP 7-225544 8/1995

OTHER PUBLICATIONS

Partial European Search Report dated Nov. 17, 2016 in European Patent Application No. 16163400.1.
Extended European Search Report dated Mar. 20, 2017 in European Patent Application No. 1613400.1.

* cited by examiner

*Primary Examiner* — Sandra Brase
(74) *Attorney, Agent, or Firm* — Staas & Halsey LLP

(57) ABSTRACT

An image forming apparatus includes an image former configured to perform printing using an LPH (LED Print Head) that emits light to a photosensitive drum based on a sync signal; a sensor configured to sense a cyclical speed of the photosensitive drum; and an LPH controller configured to adjust a generation gap of the sync signal using the sensed cyclical speed.

15 Claims, 23 Drawing Sheets

IMAGE FORMING APPARATUS, CONTROLLING METHOD OF THEREOF AND NON-TRANSITORY COMPUTER READABLE STORAGE MEDIUM

CROSS-REFERENCE TO RELATED APPLICATIONS

This application claims priority from Korean Patent Application No. 10-2015-0094480, filed on Jul. 2, 2015, in the Korean Intellectual Property Office, the disclosure of which is incorporated herein by reference in its entirety

BACKGROUND

1. Field

The following description relates to an image forming apparatus and a controlling method thereof, and more particularly, to an image forming apparatus capable of adjusting a line sync signal without changing a motor speed to perform an OPC AC compensation, and a controlling method thereof.

2. Description of the Related Art

In general, an image forming apparatus such as a printer, copying machine, multifunction copier, and facsimile and the like that use an electronic photographing method is provided with an optic injector. The image forming apparatus forms an electrostatic latent image on a surface of a photosensitive medium using an optic beam output from the optic injector, and then transcribes the image to a piece of paper and performs an operation of printing a desired image.

In the past, an LSU (Laser Scanning Unit) was mostly used as an image forming apparatus that performs the role of an optic injector. As illustrated in FIG. 1, an LSU system used a method of adjusting an optic path reflected from a rotating polygon motor to form an electrostatic latent image on a desired point of the OPC photosensitive medium. Recently, image forming apparatuses that use an LPH (LED Print Head) are being developed. As illustrated in FIG. 2, an LPH uses a method of adjacently arranging a plurality of LED arrays and exposing in pixel units.

An LSU color image forming system of a tandem method is generally configured as in FIG. 3. Print data output from a main controller goes via the LSU and forms an image on each corresponding OPC. Herein, an error in a driving system of the OPC causes an AC component corresponding to an OPC cycle. When an image pattern of equal gaps is printed as in FIG. 4, and the gap of the actual printed pattern is measured through a sensor, the error in a location as in FIG. 5 represents the AC component.

In an LSU system, a sync signal in a main injection direction that forms an image on the OPC is generated using a BD (Beam Detect) signal that occurs while a polygon mirror rotates. This is configured to operate completely separate from the driving system that drives the OPC. Conventional methods for OPC AC compensation include a method of eliminating the AC component by controlling a rotation speed of the OPC and a method of reducing a registration error caused by the AC component by matching a mechanical phase so that the AC component of each color coincides to one another. These are methods of controlling the OPC motor. When intending to perform an AC compensation as aforementioned, a motor must be controllable per color. For this purpose, there needs to be provided a motor for each OPC, and thus there exists a problem of increasing manufacturing cost. Furthermore, the method of matching the mechanical phase so that the AC component of each color coincides to one another leads to a problem of deteriorating manufacturing productivity.

In the LSU system, there needs to be just one data line to be input to a laser diode. However, in the case of an LPH system, an array configuration matched to the size area of a page drives numerous devices at the same time, and thus more data lines are needed compared to the LSU system.

Furthermore, in the case of a color image forming apparatus, there needs to be 4 times more data lines than a black and white image forming apparatus.

For such reasons, it is not suitable for an SoC (System on Chip) or main controller of an image forming apparatus to include an LPH controller. Accordingly, in an image forming system using LPH, the main controller and LPH controller are usually separated from each other. In generally, the LPH controller is adjacent to an LPH module, and is connected to the main controller using a relatively long cable.

In the case of applying the LPH technology to the main controller and SoC developed for a conventional LSU, if not using a video interface for LSU use, a separate parallel interface must be used for transmission of printing data. In order to support multi-bit data for expressing multi tones for high resolution, the amount of data to be transmitted must be twice the amount in the case of 2 bit, and thus the line width of transmission data must be increased or the transmission rate of the data must be increased to twice the rate. Furthermore, at the receiving side, a frequency of a data clock for print data latching must be increased to twice the frequency. In the case of an image forming apparatus for LPH use, in order to prevent error due to a relatively long transmission distance between the main controller and LPH controller, a differential signal such as an LVDS is used. Accordingly, when using the method of increasing the line width of the transmission data for multi-bit transmission, the line width increases to twice the width. In order to increase the transmission rate of the transmission data without increasing the line width, the data clock frequency must be increased to twice the frequency, and thus there occurs a problem of limitations in the high speed high resolution system.

SUMMARY

Additional aspects and/or advantages will be set forth in part in the description which follows and, in part, will be apparent from the description, or may be learned by practice of the disclosure.

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

A purpose of the present disclosure is to resolve the aforementioned problems of prior art, that is to provide a color image forming apparatus that uses LPH and configured to individually adjust a line sync per color to individually compensate an AC compensate instead of individually controlling the speed of a motor for OPC AC compensation.

Another purpose of the present disclosure is to provide an image forming apparatus configured to transmit print data to an LPH controller using a conventional video interface without an increase of data lines of the print data or increase of a data clock frequency by adjusting a pulse location of video data when transmitting multi-level data for high speed high resolution printing in a case of configuring an image forming system using LPH.

According to an embodiment of the present disclosure, an image forming apparatus includes an image former configured to perform printing using an LPH (LED Print Head) that emits light to a photosensitive drum based on a sync signal; a sensor configured to sense a cyclical speed of the photosensitive drum; and an LPH controller configured to adjust a generation gap of the sync signal using the sensed cyclical speed.

The image former may include a plurality of photosensitive drums and a plurality of LPHs, the sensor may sense a cyclical speed of each of the plurality of photosensitive drums, and the LPH controller may include a plurality of LPH controllers configured to adjust a generation gap of each sync signal provided in the plurality of LPHs.

At least one of the plurality of LPH controllers may generate a sync reference signal, and transmit the generated sync reference signal to the remaining LPH controllers, and the plurality of LPH controllers may grant an offset to the sync reference signal to presume the sensed cyclical speed of each of the photosensitive drum to generate a sync signal where a generation gap has been compensated.

A sync signal regarding each of the plurality of photosensitive drums may be a K line sync signal, C line sync signal, M line sync signal, and Y line sync signal, and a K line sync signal, C line sync signal, M line sync signal, and Y line sync signal where the offset has been granted may be generated at different timings to one another.

The LPH controller may generate a line sync signal and page sync signal with the sync signal, grant an offset only to the line sync signal, and thus a timing of the page sync signal and a timing of the line sync signal not matching each other.

The image former may form a predetermined pattern on an image forming medium, and the sensor may sense the pattern formed on the image forming medium, and sense a cyclical speed of the photosensitive drum.

The LPH controller may check gap change of the photosensitive drum through the sensed pattern formed on the image forming medium, and adjust a generation gap of the sync signal to compensate the gap change.

The LPH controller, in response to sensing that a gap of the formed pattern is narrower than a predetermined gap, may adjust the generation gap of the sync signal to be wider, and in response to sensing that a gap of the formed pattern is wider than the predetermined gap, may adjust the generation gap of the sync signal to be narrower.

According to an embodiment of the present disclosure, an image forming apparatus includes an image former configured to perform printing using an LPH (LED Print Head) that emits light to a photosensitive drum; and a main controller configured to transmit a video signal of a single bit corresponding to print data received to the LPH controller; wherein the LPH controller converts the received video signal of the signal bit into a video signal of multi bit that is recognizable in the LPH, and the main controller is a main controller being used in an image forming apparatus that uses an LSU (Laser Scanning Unit).

The main controller may adjust a pulse width and location of the video signal of a single bit, and transmit the video signal of a single bit to the LPH controller through a video interface.

The LPH controller may extract data for calculating an amount of light of each LED that forms the LPH using the pulse width and location of the received video signal of a single bit.

According to an embodiment of the present disclosure, a method for controlling an image forming apparatus includes sensing a cyclical speed of a photosensitive drum; adjusting a generation gap of the sync signal using the sensed cyclical speed; and performing printing using an LPH (LED Print Head) that emits light to the photosensitive drum based on the adjusted sync signal.

The image forming apparatus may include a plurality of photosensitive drums and a plurality of LPHs, the sensing may involve sensing a cyclical speed of each of the plurality of photosensitive drums, and the adjusting may involve adjusting a generation gap of each sync signal being provided to the plurality of LPHs.

The method may further include generating a sync reference signal by at least one of the plurality of LPH controllers and transmitting the generated sync reference signal to the remaining LPH controllers; wherein the adjusting may involve granting an offset to the sync reference signal to presume the sensed cyclical speed of each of the photosensitive drum to generate a sync signal where a generation gap has been compensated.

The sync signal regarding each of the plurality of photosensitive drums may be a K line sync signal, C line sync signal, M line sync signal, and Y line sync signal, and the K line sync signal, C line sync signal, M line sync signal, and Y line sync signal where the offset has been granted may be generated at different timings to one another.

The adjusting may involve generating a line sync signal and page sync signal with the sync signal, and granting an offset only to the line sync signal, and thus a timing of the page sync signal and a timing of the line sync signal not matching each other.

The method may further include forming a predetermined pattern on an image forming medium, wherein the sensing may involve sensing the pattern formed on the image forming medium, and sensing a cyclical speed of the photosensitive drum.

The adjusting may check gap change of the photosensitive drum through the sensed pattern formed on the image forming medium, and adjust a generation gap of the sync signal to compensate the gap change.

The adjusting, in response to sensing that a gap of the formed pattern is narrower than a predetermined gap, may adjust the generation gap of the sync signal to be wider, and in response to sensing that a gap of the formed pattern is wider than the predetermined gap, adjust the generation gap of the sync signal to be narrower.

According to an embodiment of the present disclosure, a non-transitory computer-readable record medium comprising a program for executing a controlling method of an image forming apparatus includes sensing a cyclical speed of a photosensitive drum; adjusting a generation gap of the sync signal using the sensed cyclical speed; and performing printing using an LPH (LED Print Head) that emits light to the photosensitive drum based on the adjusted sync signal.

By the aforementioned disclosure, it is possible to perform OPA AC compensation without controlling a motor separately. Furthermore, by utilizing a video interface that used to be used in a conventional image forming apparatus that uses LSU in an image forming apparatus that uses LPH, there is an effect of not having to provide an additional parallel interface. Furthermore, there is also an effect of not having to expand a line for transmitting print data or increase a clock frequency in expression multi tones.

BRIEF DESCRIPTION OF THE DRAWINGS

The above and/or other aspects of the present disclosure will be more apparent by describing predetermined exemplary embodiments of the present disclosure with reference to the accompanying drawings, in which.

DETAILED DESCRIPTION

Figure 1:
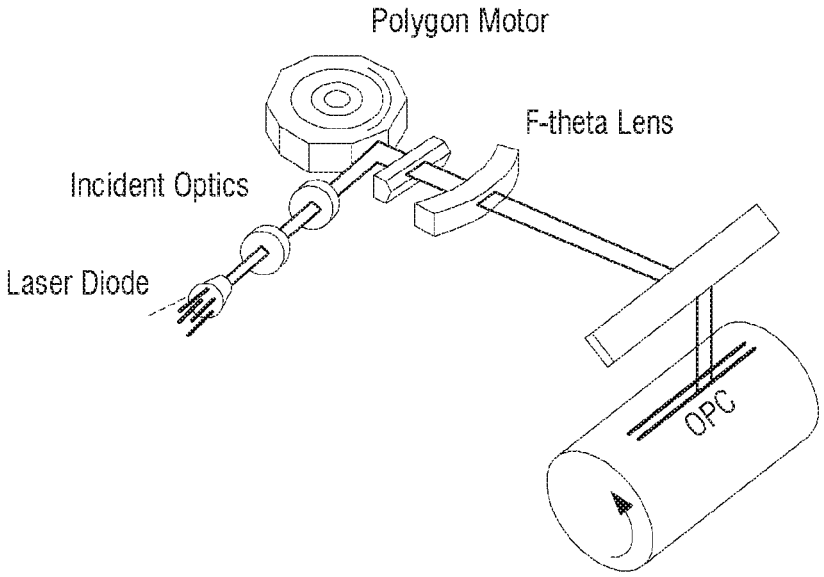
FIG. 1 is a view illustrating an image forming apparatus that uses an LSU.
Figure 2:
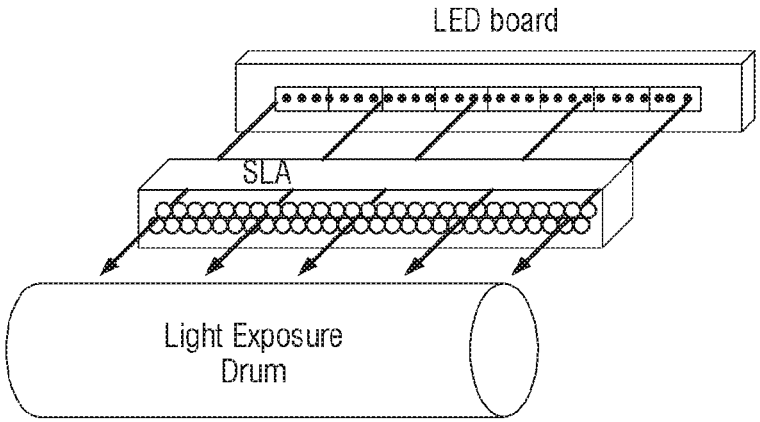
FIG. 2 is a view illustrating an image forming apparatus that uses an LPH.
Figure 3:
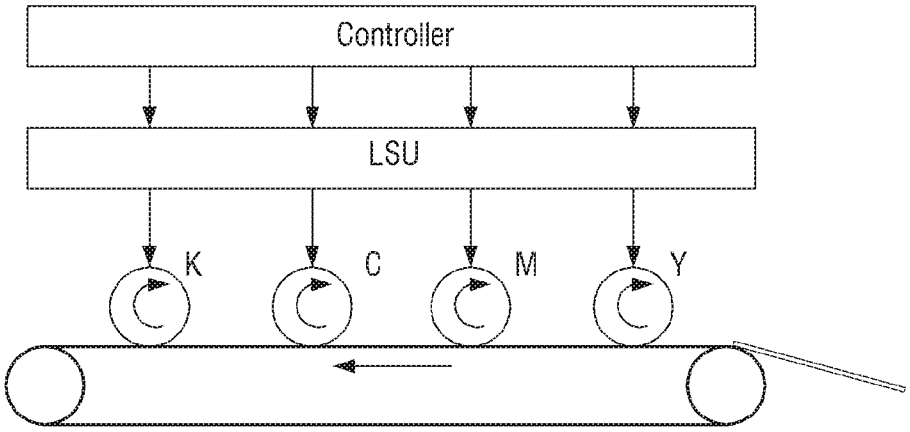
FIG. 3 is a view illustrating a configuration of an LSU color image forming apparatus of a tandem method.
Figure 4:
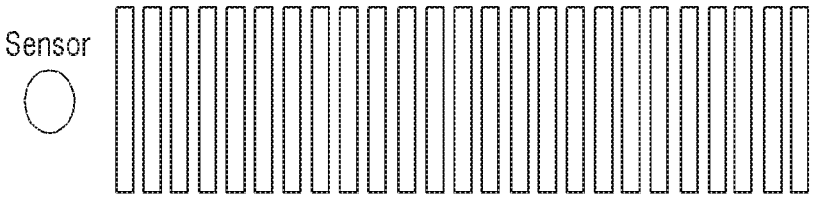
FIG. 4 is a view illustrating a pattern of equal gaps for OPC AC compensation being sensed by a sensor.
Figure 5:
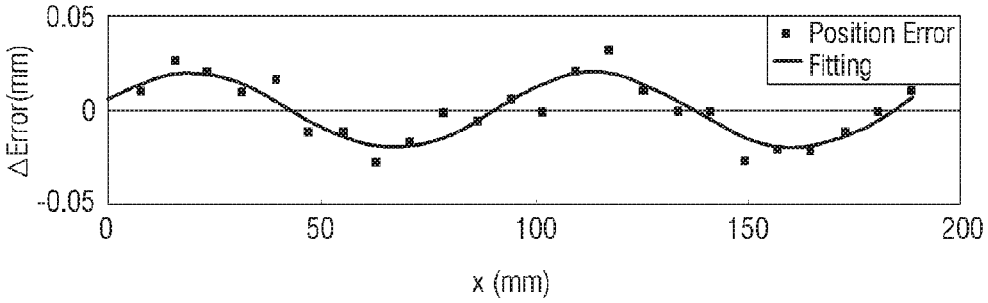
FIG. 5 is a graph illustrating an error of a gap of a printed pattern showing an AC format.

Reference will now be made in detail to the embodiments, examples of which are illustrated in the accompanying drawings, wherein like reference numerals refer to like elements throughout. The embodiments are described below to explain the present disclosure by referring to the figures.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail because they would obscure the disclosure with unnecessary detail.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Hereinafter, the present disclosure will be described in detail with reference to the accompanying drawings.

Figure 6:
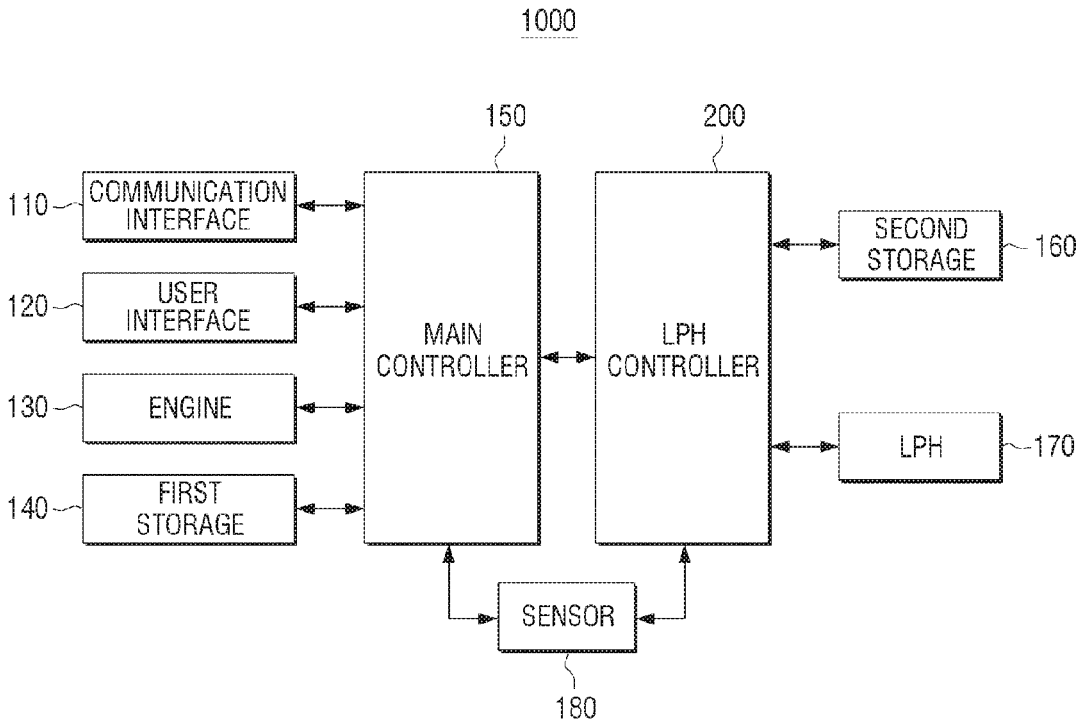
FIG. 6 is a block diagram for explaining a configuration of an image forming apparatus according to an embodiment of the present disclosure.

FIG. 6 is a view illustrating a configuration of an image forming apparatus according to an embodiment of the present disclosure. Referring to FIG. 6, the image forming apparatus 1000 includes a communication interface 110, user interface 120, engine 130, first storage 140, main controller 150, second storage 160, LPH 170, sensor 180, and LPH controller 200.

Herein, the image forming apparatus 1000 is an apparatus for generating, printing, receiving, and transmitting image data. The image forming apparatus 1000 may be a printer, copier, facsimile, or multi-function copier where functions of the printer, copier, and facsimile are combined. This embodiment was disclosed as being applicable to an image forming apparatus that forms images, but in other embodiments, the same may be applied to an image reading apparatus such as a scanner.

The communication interface 110 is connected to a print control terminal apparatus (not illustrated) such as a PC, notebook PC, PDA, and digital camera and the like. More specifically, the communication interface 110 is configured to connect the image forming apparatus 100 to an external apparatus, and may be connected to the print control terminal apparatus through not only a LAN (Local Area Network) and internet network, but also a USB (Universal Serial Bus) port. Furthermore, the communication interface 110 may be configured to be connected to the print control terminal apparatus in a wired method but also in a wireless method.

Furthermore, the communication interface 110 receives print data from the print control terminal apparatus (not illustrated). Furthermore, in a case where the image forming apparatus 1000 has a scanner function, the communication interface 110 may transmit the generated scan data to the print control terminal apparatus or to an external server (not illustrated). Furthermore, the communication interface 110 may receive a print control command from the print control terminal apparatus (not illustrated).

The user interface 120 is provided with a plurality of functional keys through which a user may set or select various functions being supported in the image forming apparatus 1000, and the user interface 120 displays various information being provided in the image forming apparatus 100. The user interface 120 may be realized as an apparatus where inputs and outputs may be realized at the same time such as a touch screen, or as a combined apparatus of an input apparatus such as a mouse (or keyboard, a plurality of buttons) and an output apparatus such as a monitor. The user may control print operations of the image forming apparatus 1000 using a user interface window being provided through the user interface 120.

Furthermore, the user interface 120 may display an operational state of the image forming apparatus 1000. For example, in a case where the image forming apparatus is in a printing process, the user interface 120 may display that it is printing.

The engine 130 performs an operation of forming an image. More specifically, the engine 130 includes 4 photosensitive drums (Dy)(Dc)(Dm)(Dk) prepared to correspond to 4 colors of yellow, cyan, magenta, and black, a light exposure apparatus configured to inject light to each of the photosensitive drums (Dy)(Dc)(Dm)(Dk) to form an electrostatic latent image of a desired image, a developing apparatus configured to develop the electrostatic latent image with a developing fluid for each color, and an image forming medium (or transfer belt, intermediate transfer belt) configured to receive images developed in each of the photosensitive drums (Dy)(Dc)(Dm)(Dk) sequentially in an overlapping manner and to form images of completed colors and then to transfer the result to a piece of paper. In an image forming apparatus according to an embodiment of the present disclosure, the light exposure apparatus includes an LPH 170. In the LPH, LEDs are arranged in an array format. The LED array is configured to correspond to a printing width, and to expose light in a pixel unit using each LED device.

The motor (not illustrated) is a direct current motor provided inside the image forming apparatus 1000, and the motor may perform a constant velocity or accelerated driving according to an amount of current being input. The motor may be a motor for driving a photosensitive drum, for driving a fusing device, or for performing various functions of the image forming apparatus such as transferring a piece of paper.

Because the image forming apparatus according to an embodiment of the present disclosure does not need to control the motor separately, it is possible to drive all 4 photosensitive drums using a single motor. By way of another example, the 4 photosensitive drums and the image forming medium may be driven together by a single motor. However, the image forming apparatus 1000 may include a plurality of motors each driving a photosensitive drum, and thus there is no limitation to a single motor.

The first storage 140 stores print data. More specifically, the first storage 140 stores print data received through the communication interface 110. Furthermore, the first storage 140 may be realized as a storage medium and external storage medium inside the image forming apparatus 1000, for example, a removable disk, or web server via a network that includes a USB memory.

Furthermore, the first storage 140 may store LPH light amount information, information on location of an LED chip, and function for controlling a sync signal that may be stored in a second storage 160 that will be explained hereinafter.

The main controller 150 controls each component inside the image forming apparatus 1000. More specifically, in response to receiving print data from the print control terminal apparatus, the main controller 150 transmits the received print data to the LPH controller 200. Furthermore, the main controller 150 may set a print setting parameter of the LPH controller 200 prior to the actual printing operation.

When a printing operation is initiated, the main controller 150 receives a line sync signal (LSYNC) and page signal (PSYNC) generated in the LPH controller 200. In response, the main controller 150 transmits the print data to the LPH controller 200.

Hereinafter, an example where a line sync signal and a page sync signal are both generated in the LPH controller 200 will be explained. However, a line sync signal, page sync signal, and sync reference signal may all be generated in the main controller 150. For example, in a case where a sync reference signal is being generated in the main controller 150, there is no need to transmit the sync reference signal between the plurality of LPH controllers 200.

The second storage 160 stores data being used in the LPH controller 200. For example, the second storage may be realized as an EEPROM (Electrically Erasable Programmable Read-Only Memory) that is a type of nonvolatile memory.

The second storage 160 stores information on the LPH such as information on the light amount of the LPH and information on the location of the LED chip. Characteristics of the LED may differ depending on its manufacturing characteristics, and thus an amount of light of each device must be controlled separately. In order to obtain a uniform concentration, the second storage 160 stores information on the amount of light of the LED device. The information on the amount of light of the LED device stored in the second storage 160 is set in an internal register of the LPH controller 200 through an additional interface before printing is performed, and used to generate uniform print images.

Furthermore, the second storage 160 may store an AC compensation table for AC compensation, and a function to be used in the AC compensation.

The sensor 180 senses a cyclical speed of a photosensitive drum. More specifically, the sensor 180 senses a flux (or rotary speed) while the photosensitive drum rotates once. It would be ideal if the rotary speed of the photosensitive drum is constant while the photosensitive drum rotates once, but in reality, the rotary speed of the photosensitive drum is not constant due to reasons such as a shape error (eccentricity, run-out and the like) of the photosensitive drum, drum alignment error, gear shape error, gear transmission error, structural incompleteness of a gear train, and coupling angle transmission error and the like. Because a photosensitive drum is a rotary system, such a change of speed occurs cyclically. Due to the characteristics of cyclical speed change, gap change in the pattern being transferred to the image forming apparatus will show an AC shape such as a sine curve. This is called OPCAC.

For example, the sensor 180 may sense the cyclical speed of the photosensitive drum in a method of reading a patch formed in the photosensitive drum or image forming medium by a sensor. Herein, the patch may include a pattern of equal gaps. Instead of using a sensor for only sensing purpose, a concentration sensor may be used.

By way of another example, the sensor 180 may receive an encoder value through an encoder installed in an OPC motor, and sense a cyclical speed of the photosensitive drum.

Figure 7:
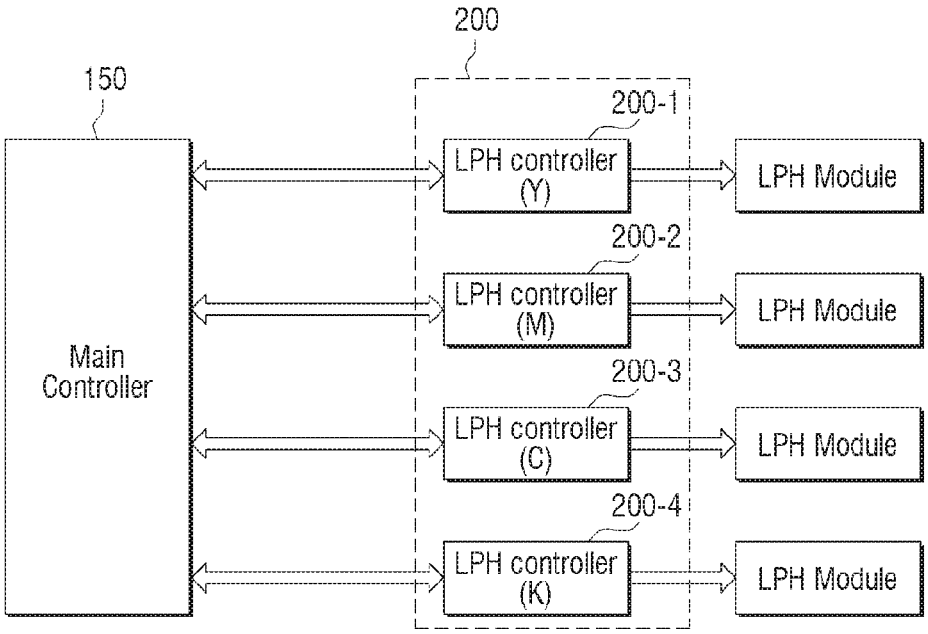
FIG. 7 is a view illustrating an LPH controller being configured per color in an image forming apparatus according to an embodiment of the present disclosure.

The LPH controller 200 performs an operation for driving the LPH 170. In order to use a main controller or SoC of the image forming apparatus of a conventional LSU method, an additional LPH controller 200 is needed. In order to driving the LPH, there exists an LPH controller 200 between the LPH and the main controller 150. Because an LPH is arranged in a photosensitive drum per color, the LPH controller 200 must also be provided per color as well. For example, as illustrated in FIG. 7, the LPH controller 200 may include 4 LPH controllers 200-1, 200-2, 200-3, 200-4, each respectively corresponding to Y, M, C, and K.

Configuration of the LPH controller 200 will be explained in detail with reference to FIGS. 8 and 9.

Figure 8:
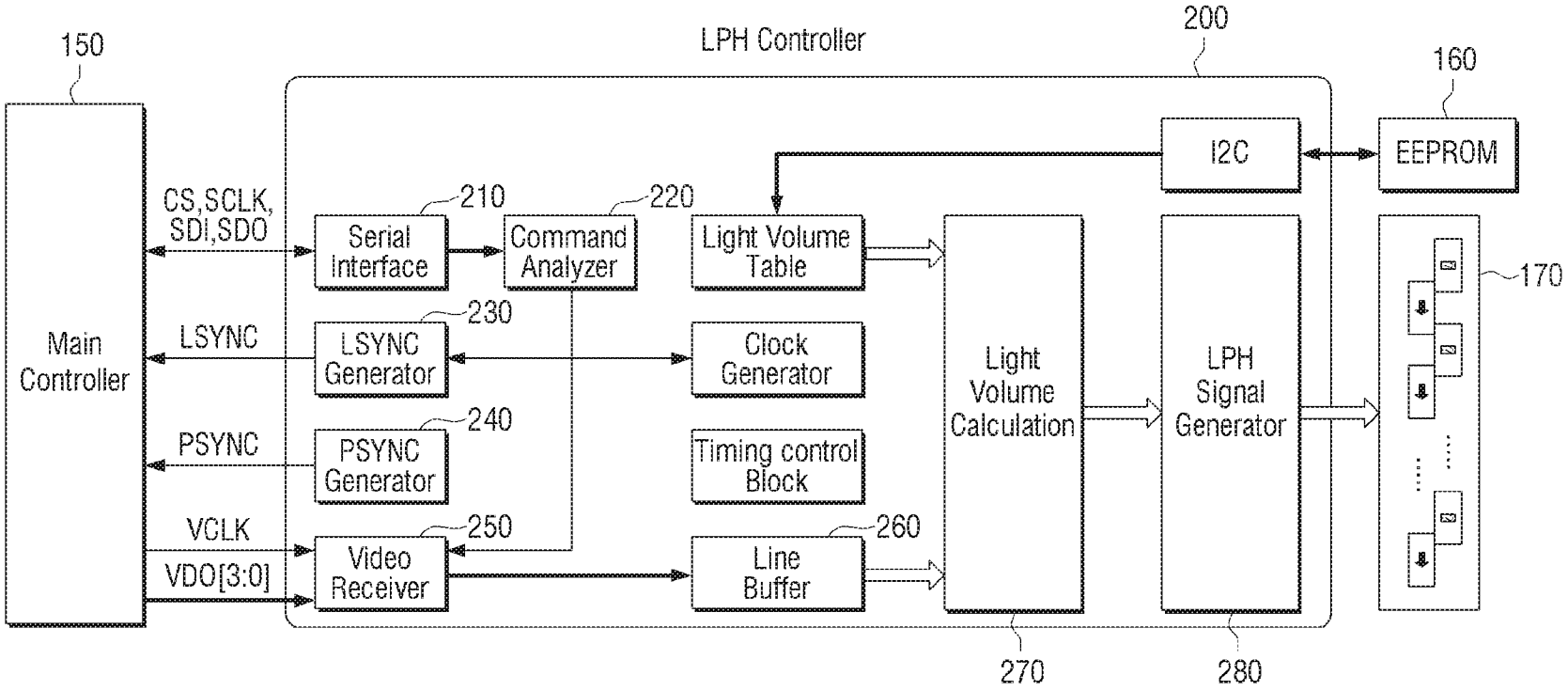
FIG. 8 is a block diagram for explaining in detail a configuration of an LPH controller.

FIG. 8 is a block diagram for explaining a configuration of the LPH controller 200. For convenience of explanation, it is illustrated that there is 1 (one) LPH controller 200 connected to the main controller 150. Referring to FIG. 8, the LPH controller 200 may include a serial interface 210, command analyzer 220, LSYNC generator 230, PSYNC generator 240, video receiver 250, line buffer 260, light amount calculator 270, and LPH signal generator 280.

The serial interface 210 is a configuration for communicating with the main controller 150 regarding a print control setting and the like. Through the serial interface 210, a signal such as a chip selection CS, serial clock SCLK, serial data input/output SDI, SDO and the like may be transmitted between the main controller 150 and LPH controller 200. The serial interface 210 may be realized as a UART (Universal Asynchronous Receiver/Transmitter), I2C (Inter-Integrated Circuit), and SDIO (Secure Digital Input Output).

Prior to a print operation, the main controller 150 sets a print setting parameter of the LPH controller 200. Herein, the command analyzer 220 sets print setting parameters of the LPH controller 200 through the serial interface 210.

A conventional image forming apparatus using LSU uses a line sync signal using a BD (Beam Detect) being generated as a polygon mirror rotates. However, in the image forming apparatus that uses LPH according to an embodiment of the present disclosure does not have a driving system that rotates the polygon mirror, and thus the LSYNC generator 230 generates a line sync signal separately. The LSYNC is a line sync signal for matching a line sync of printing. A generation frequency of the LSYNC may be set in not only the LPH controller 200 but also in the main controller 150.

The PSYNC generator 240 generates a PSYNC that announces a starting point of printing. The PSYNC is a page sync signal. The page sync signal is generated sequentially per color with a time difference in consideration of a physical gap of the photosensitive drum per color. A time of generation of a PSYNC may be set not only in the LPH controller 200 but also in the main controller 150.

The LSYNC generator 230 and PSYNC generator 240 may be realized to be included in the main controller 150, or configured as a separate controller.

The video receiver 250 receives print data from the main controller 150. The print data may be a video signal being transmitted through a video interface. The main controller 150 may adjust a pulse width and location of the print data using PWN control and the like. The video receiver 250 may be re-configured as multi bit data using the video signal and VCLK signal. The multi it data is used to calculate an amount of light of each LED device of the LPH.

The line buffer 260 controls such that the print data received in the video receiver 250 is output suitably to the location of the LED.

The light amount calculator 270 calculates an amount of light of each LED so that a uniform image may be obtained. The light amount calculator 270 may calculate an amount of light of each LED device that forms the LPH using the multi bit data and light amount table.

The LPH signal generator 280 generates an LPH driving signal based on the print data and the calculated light amount.

Figure 9:
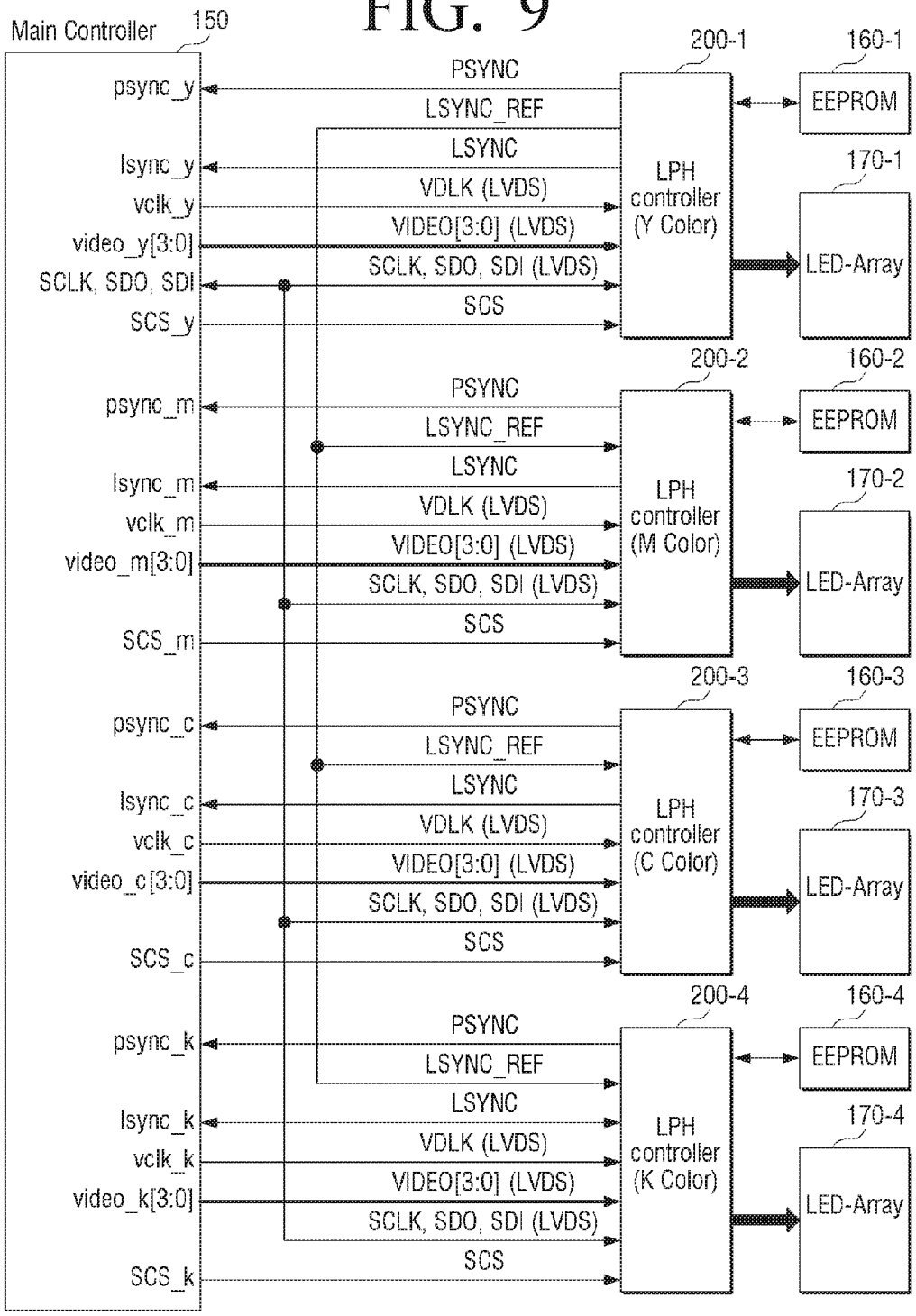
FIG. 9 is a view for explaining signal transmission between a main controller and a plurality of LPH controllers.

FIG. 9 is a view with a main focus on signals being transmitted between the main controller 150, and a plurality of LPH controllers 200-1, 200-2, 200-3, and 200-4.

Referring to FIG. 9, each of the plurality of LPH controllers 200-1, 200-2, 200-3, 200-4 generates an LSYNC and PSYNC, and transmits the same to the main controller 150. Each of the plurality of LPH controllers 200-1, 200-2, 200-3, 200-4 respectively communicates with the plurality of second storage 160-1, 160-2, 160-3, and 160-4, and the plurality of LPH 170-1, 170-2, 170-3, and 170-4. Furthermore, each of the plurality of LPH controllers 200-1, 200-2, 200-3, 200-4 receives print data in a video signal format from the main controller 150.

Each of the plurality of LPH controllers 200-1, 200-2, 200-3, 200-4 includes a clock generator inside thereof in order to generate a sync signal. In a case of using the clock signal generated in the clock generator inside the LPH controller 200, there may be a little difference in each clock frequency depending on the characteristics of the chip. When an LSYNC is generated using such a clock signal, the LSYNC generated in the plurality of LPH controllers 200-1, 200-2, 200-3, 200-4 cannot realize an exact sync.

In order to prevent such an error, one LPH controller 200-1 of the plurality of LPH controllers 200-1, 200-2, 200-3, 200-4 generates a line sync reference signal (LSYNC_REF) and transmits the same to the other LPH controllers 200-2, 200-3, 200-4, thereby realizing an exact sync of LSYNC. In FIG. 9, it is illustrated that the LPH controller 200-1 that is in charge of color Y generates a LSYNC_REF and transmits the same to the other LPH controllers 200-2, 200-3, 200-4 that are in charge of colors M, C, K. However, the LSYNC_REF may not necessarily be generated in the LPH controller 200-1 that is in charge of color Y.

In an embodiment where the LSYNC generator 230 is realized inside the main controller 150, there is no need for an operation for such an LSYNC sync. That is because, LSYNC signals used in all of the plurality of LPH controllers 200-1, 200-2, 200-3, 200-4 are generated in a single chip, that is main controller 150.

Figure 10:
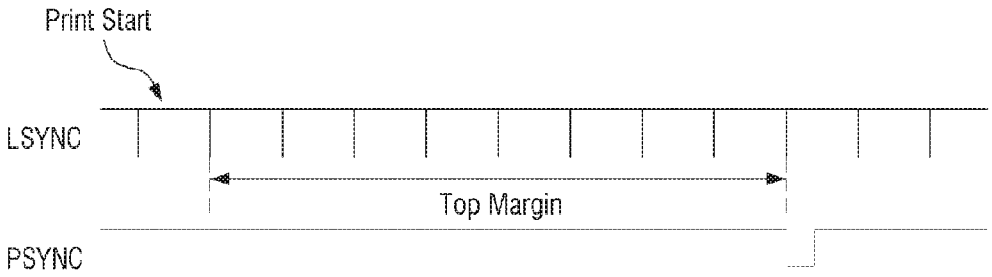
FIG. 10 is a view illustrating a relationship between a line sync signal and a page sync signal.

FIG. 10 is a view illustrating a relationship between the line sync signal (LSYNC) and page sync signal (PSYNC).

When printing is initiated, the LPH controller 200 generates a page sync signal. As illustrated in FIG. 10, the page sync signal is generated after a predetermined time delay from a print start signal. A delay value (Top margin) may be set differently for each color so that each of the plurality of LPH controllers 200-1, 200-2, 200-3, 200-4 has a different location of generation of a page sync signal. This is because there is a difference in the physical locations of the plurality of photosensitive drums.

For example, a delay value (Top margin) of a page sync signal may be set in units of line sync signals. Accordingly, at an initial state, the generation timing of the line sync signal and the page sync signal matches each other as illustrated in FIG. 10.

However, in a case of compensating a generation gap of a line sync signal so that a cyclical speed of a photosensitive drum may presume a predetermined speed according to an embodiment of the present disclosure, offset is granted to the line sync signal only, and thus the timing of the page sync signal and the line sync signal do not match each other. From the fact that the generation timing of the line sync signal and page sync signal do not match each other, one can see that an OPC AC compensation according to an embodiment of the present disclosure has been applied.

Figure 11:
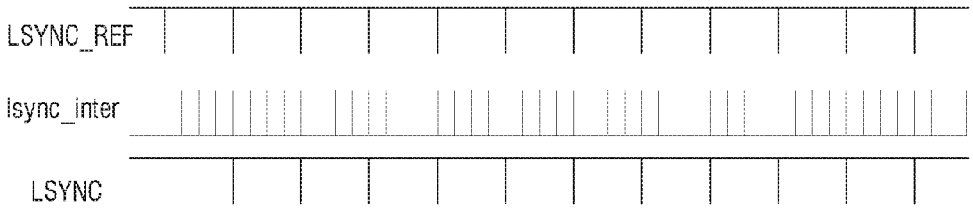
FIG. 11 is a view illustrating a relationship between a line sync reference signal, line sync inter signal, and line sync signal.

FIG. 11 is a view illustrating a relationship between a line sync reference signal (LSYNC_REF), line sync inter signal (lsync_inter) and line sync signal (LSYNC) in a case of the main controller 150 transmitting print data to 4 beam data.

The LPH controller 200 generates a line sync signal and transmits the line sync signal to the main controller 150. The generation cycle of the line sync signal may be adjusted according to a predetermined value. Adjusting the generation cycle of the line sync signal may be set to be made in the main controller 150. It is a matter of course that adjusting the generation cycle of the line sync signal may be set to be made in the LPH controller 200 as well.

Referring to FIG. 11, the main controller 150 transmits print data to 4 beam data, and accordingly 4 lines to be printed are output at the same time. An lsync_inter signal is generated in 1 line units, and synchronizes output of lines to be printed. The LPH controller 200 generates a line sync signal every time an lsync_inter signal is generated four times, and transmits the line sync signal to the main controller 150.

Figure 12:
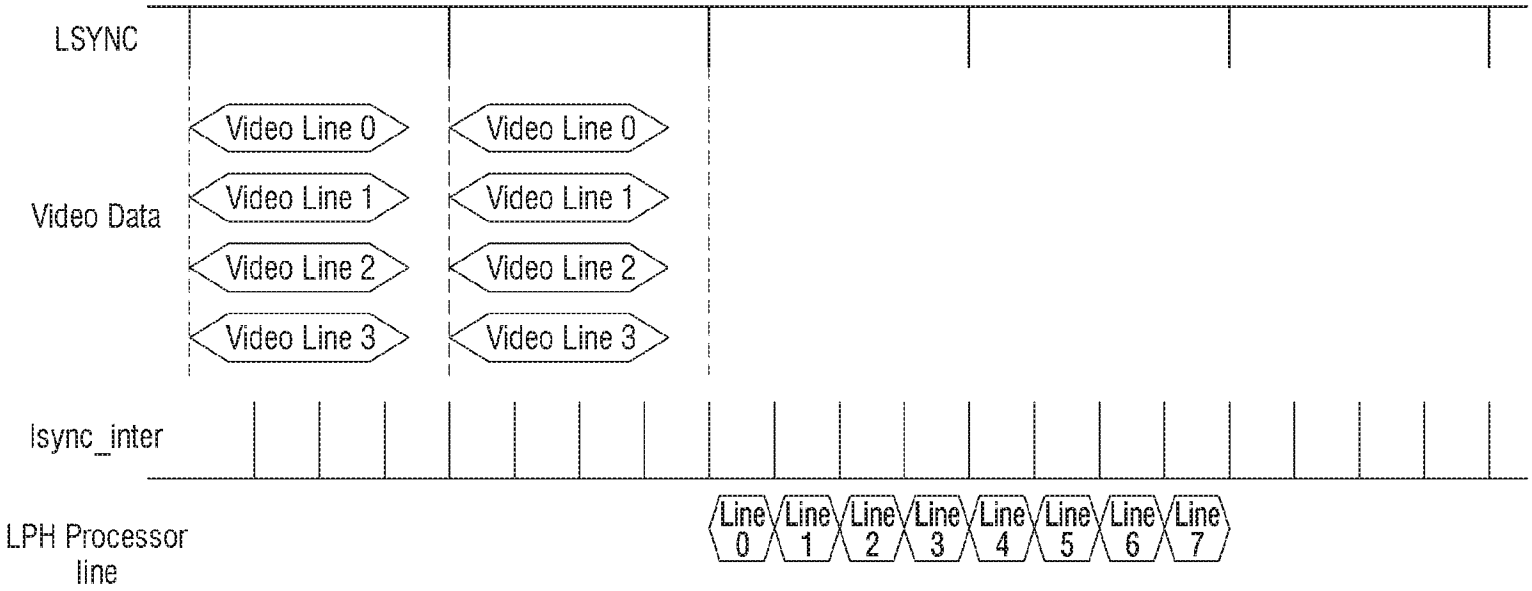
FIG. 12 is a view illustrating a video data processing method.

More specifically, as illustrated in FIG. 12, the main controller 150 transmits print data to the LPH controller 200 according to the line sync signal. The print data may be a video signal capable of adjusting a pulse width and location. The main controller 150 may transmit the print data to the LPH controller 200 through the video interface being used in a conventional LSU image forming apparatus.

Referring to FIG. 12, the main controller 150 transmits to the LPH controller 200 the print data regarding 4 lines in line sync signal units. The LPH controller 200 buffers the print data regarding the 4 lines, and process one line at a time in lsync_inter units.

Figure 13:
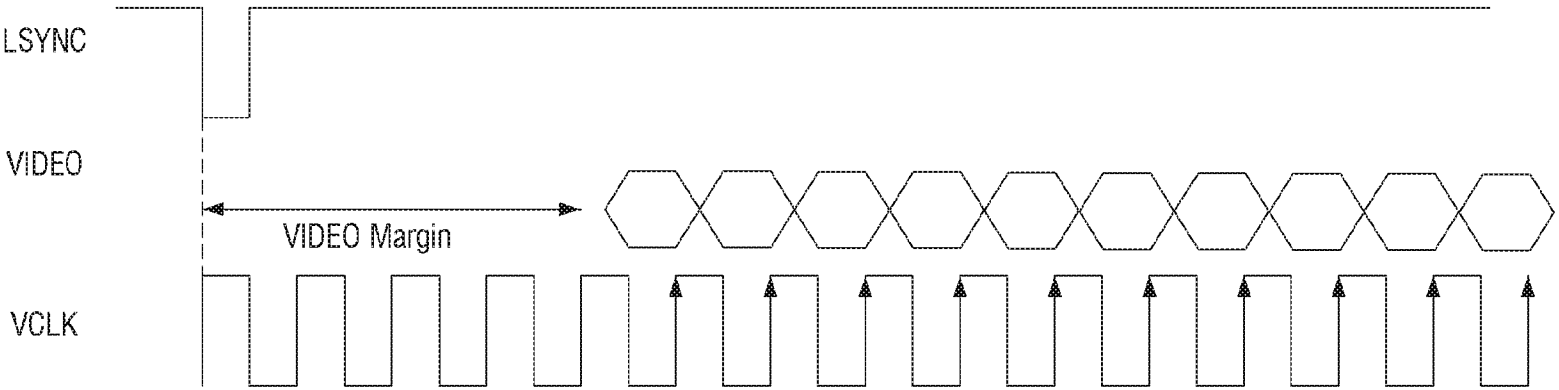
FIG. 13 is a view illustrating video data received from an LPJ controller and a VCLK timing.

The main controller 150 may transmit to the LPH controller 200 not only print data that is a video signal but also a VCLK signal. As illustrated in FIG. 13, the LPH controller 200 may latch the print data in a rising edge of the VCLK and receive the same.

As aforementioned, the main controller 150 may transmit print data to the LPH controller 200 through a video interface being used in a conventional image forming apparatus that uses LSU. Accordingly, the image forming apparatus that uses LPH according to an embodiment of the present disclosure has an advantage that it may realize the main controller 150 or SoC as those being used in a conventional image forming apparatus that uses LSU.

Furthermore, in a case of using a video signal in multi bit data transmission, it is possible to transmit and receive print data without having to increase the VCLK to twice the amount. In LSU, processing of multi bit for multi tone is made using a video pulse width. The image forming apparatus according to an embodiment of the present disclosure 1000 transceives print data by way of video signals, and thus even though it uses LPH, multi bit may be processed in the same method as LSU. That is, the LPH controller 200 may extract data for calculating a light amount of each LED that forms the LPH 170 using the pulse width and location of the video signal received.

Figure 14:
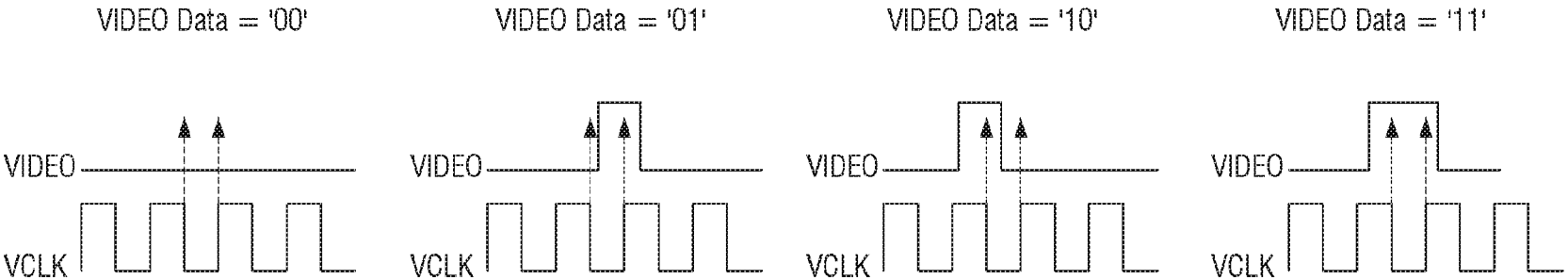
FIG. 14 is a view for explaining a multi-bit data transmission method.

For example, in a case of 2 bit, data exists in 4 types of values: '00', '01', '10', '11'. FIG. 14 illustrates such a multi bit transmission method. '00' is when there is no video data, '01' represents a half dot case biased to the right side. '10' represents a half dot case biased to the left side, and '11' represents a full dot case. As such, the main controller 150 makes definitions of multi bit and generates a video signal, and then transmits the same to the LPH controller 200 together with the VCLK. For example, the main controller 150 may transmit a video signal of a single bit corresponding to the received print data to the LPH controller 200.

The LPH controller 200 may convert the video signal of a single bit received into a video signal of multi bit recognizable in the LPH. The LPH controller 200 may receive the video signal and VCLK, latch the video data using the rising edge and falling edge of the VCLK, and re-configure the multi bit data based thereon. That is, the multi bit data may be transmitted as the pulse width and location are adjusted.

The multi bit data is used in calculating a light amount of each LED device that forms the LPH 170. By adjusting an on time of an LED or adjusting an amount of current using the result of calculating the light amount, the LPH controller 200 may realize a multi level tone of the LED.

Meanwhile, characteristics of using the video interface may be applied not only to a color image forming apparatus but also to a black and white image forming apparatus.

Hereinafter, explanation will be made on compensating an OPC AC component through line sync signal control with reference to FIGS. 15A, 15B, 16A, 16B, and 16C.

Figure 15A:
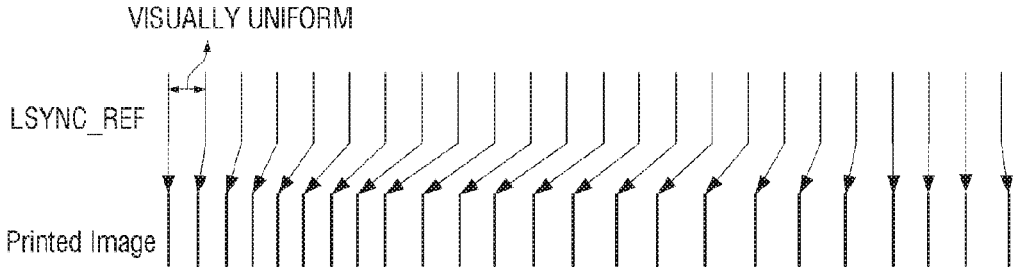
FIG. 15A and FIG. 15B are views illustrating a method for compensating a pattern where an OPC AC component is included with a line sync signal control.

In a case of forming a pattern of equal gaps on an image forming medium with an OPC AC component existing, an AC component will occur as illustrated in FIG. 15A. FIG. 15A illustrates a case where a print command has been made to form a pattern in equal gaps using a predetermined line sync reference signal (LSYNC_REF) in terms of time. However, due to mechanical errors and the like of the photosensitive drum, the gap of the pattern formed repeats becoming wider and narrower than it was first intended.

According to an embodiment of the present disclosure, the LPH controller 200 adjusts the line sync signal (LSYNC) while not changing the speed of the motor that drives the OPC to vary the point for printing the pattern, thereby forming a pattern of equal gaps as first intended.

Figure 15B:
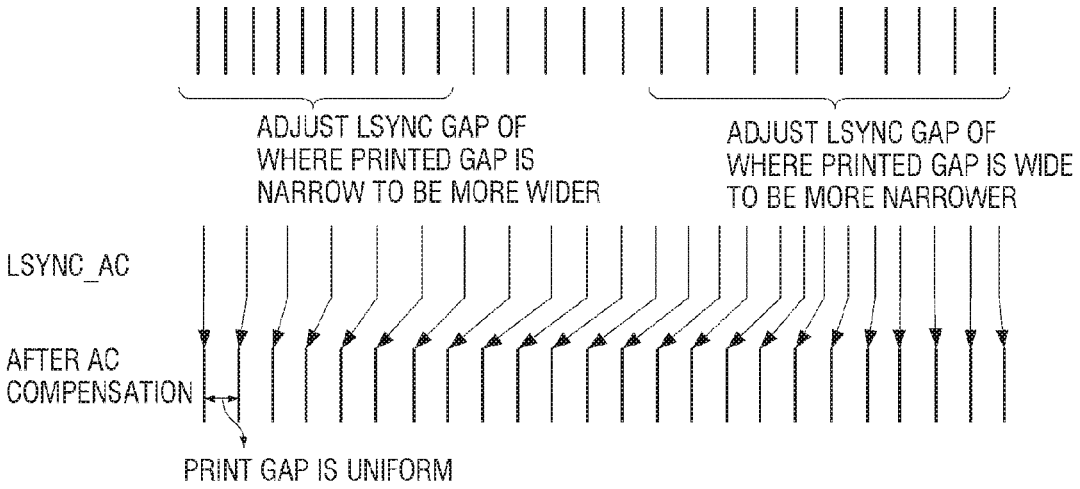

Referring to FIG. 15B, a pattern formed in an image forming medium is illustrated on the top. In response to sensing that the gap of the pattern formed is narrower than a predetermined gap, the LPH controller 200 adjusts such that a generation gap of the sync signal becomes wider. On the contrary, in response to sensing that the gap of the pattern formed is wider than the predetermined gap, the LPH controller 200 adjusts such that a generation gap of the sync signal becomes narrower. As shown in the middle of FIG. 15B, by adjusting the generation gap of the line sync signal, the error value caused by OPC AC is modified, and therefore a pattern of a uniform gap is formed as illustrated in the bottom of the figure. As such, the LPH controller 200 may compensate the OPC AC component by adjusting the generation point of a line sync signal without having to control the motor that drives the photosensitive drum.

Figure 16A:
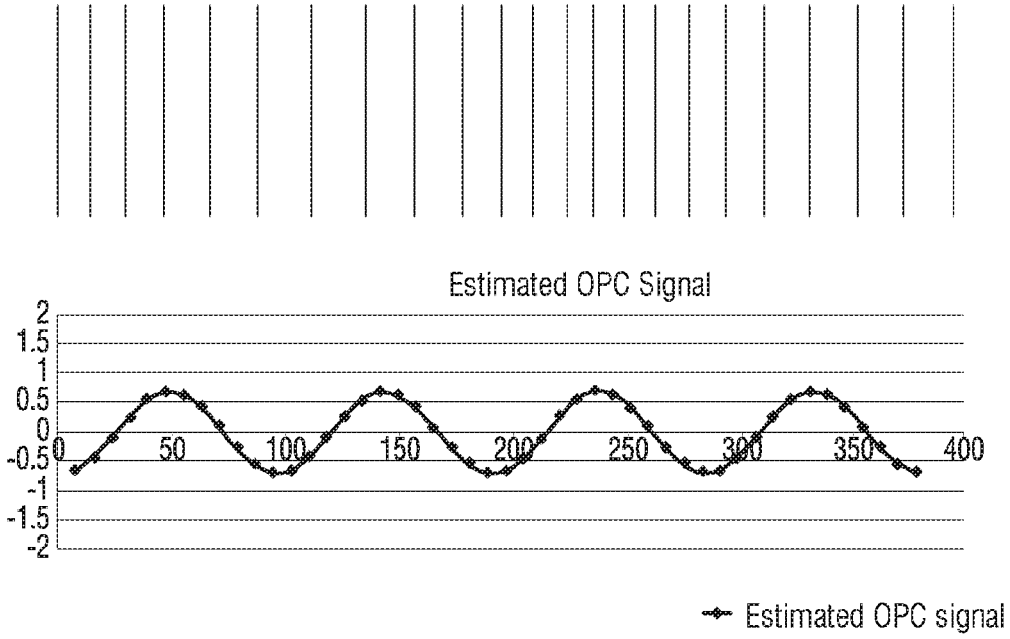
FIGS. 16A, 16B, and 16C are views illustrating OPC AC component analyzing, generation of corresponding line sync signal, and compensated line gap.
Figure 16B:
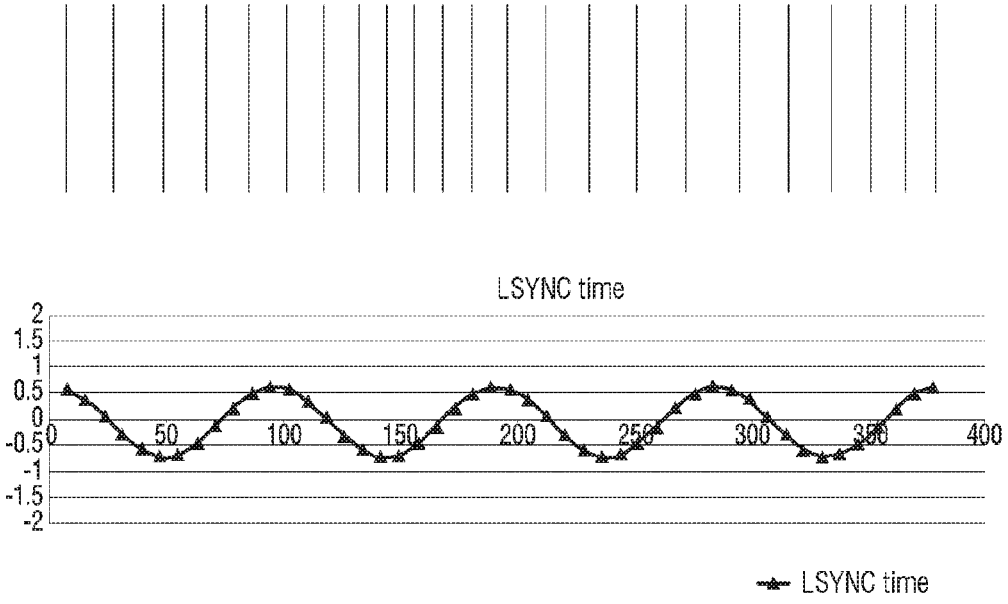
Figure 16C:
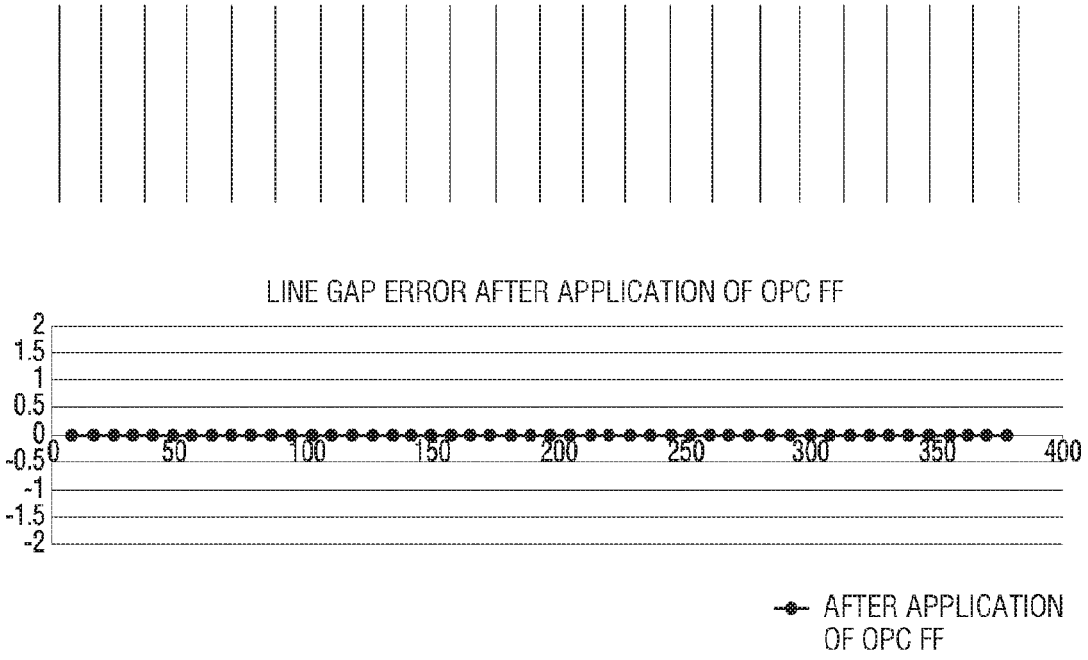

Referring to FIGS. 16A, 16B, and 16C, explanation will be made on compensating OPC AC component by adjusting of a line sync signal.

As illustrated in FIG. 16A, the image forming apparatus 1000 forms a predetermined pattern on the image forming medium. Before the OPC AC component is compensated, even if a command is made to print a pattern of equal gaps, a pattern of inconsistent gaps is formed. The sensor 180 senses the pattern formed in the image forming medium, and the LPH controller 200 calculates a location error of the sensed pattern. Because a photosensitive drum is a rotating body, the location error may be filtered in the form of a sine wave as in the AC component. The location error calculation value may be converted into a table and be stored in the second storage 160. When the AC component is filtered completely to a sine wave component, in a value corresponding to one rotation cycle of OPC (0°~360°), it may be used to adjust a generation point of a line sync signal with only ¼ (0°~90°).

FIG. 16B illustrates a pattern according to a sync signal adjusted such that an OPC AC component may be compensated by analyzing the formed pattern. A pattern formed based on a sync signal adjusted in an ideal photosensitive drum will be as the pattern illustrated on the top of FIG. 16B. When compared to the pattern illustrated in FIG. 16A, one can see that a narrow portion of a pattern gap in FIG. 16A may be formed wider in FIG. 16B. On the contrary, a wide portion of a pattern gap in FIG. 16A may be formed narrower in FIG. 16B. That is, the LPH controller 200 may adjust a gap of a line sync signal inversely using a location error table. When an adjusted sync signal of FIG. 16B is applied to a photosensitive drum having an OPC AC component as in FIG. 16A, an equal gap image is formed as in FIG. 16C.

Figure 17:
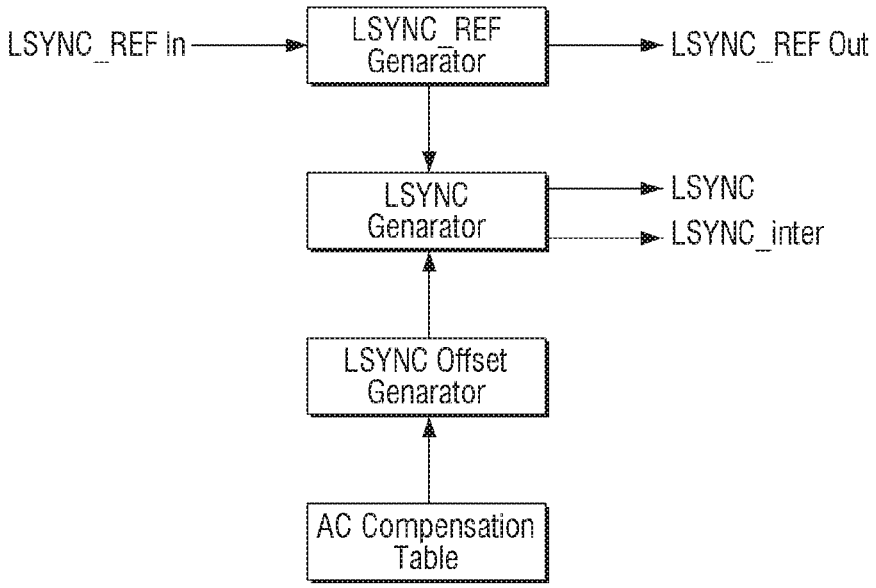
FIG. 17 is a block diagram schematically illustrating an operation of a line sync signal generator.

FIG. 17 is a view illustrating an embodiment of the line sync signal generator 230 included in the LPH controller 200. The line sync reference signal generator (LSYNC_REF Generator) generates a line sync reference signal according to a frequency of the line sync signal set in the main controller 150 or LPH controller 200. The generated line sync reference signal is transmitted to all the LPH controllers 200. Accordingly, it is possible to control such that the timing of the line sync reference signal of all the LPH controllers 200 are the same.

The AC compensation table includes information necessary for adjusting a generation gap of a line sync signal for compensating an OPC AC component. The AC compensation table may include information on a location error of a pattern formed in the image forming medium. For example, if an AC compensation table value is 0, the LPH controller 200 determines that the generation gap of the line sync reference signal and the generation gap of the line sync signal are the same. If the AC compensation table value is a positive number, the LPH controller 200 may grant an offset such that the generation gap of the line sync signal increases, and if the AC compensation table value is a negative number, the LPH controller 200 may grant an offset such that the generation gap of the line sync signal decreases. The AC compensation table may be synchronized by a signal being input at every rotation cycle of the OPC. In such a case, the AC compensation table may include a value corresponding to one cycle of the OPC.

The LSYNC offset generator calculates the offset to be applied to the line sync signal. An offset means offsetting with the line sync reference signal (LSYNC_REF) that is the original line sync signal of which AC has not been compensated. Using an offset value and the line sync reference signal, the LSYNC offset generator 230 may generate a line sync signal and a line sync inter signal (lsync_inter) to be used internally.

Figure 18:
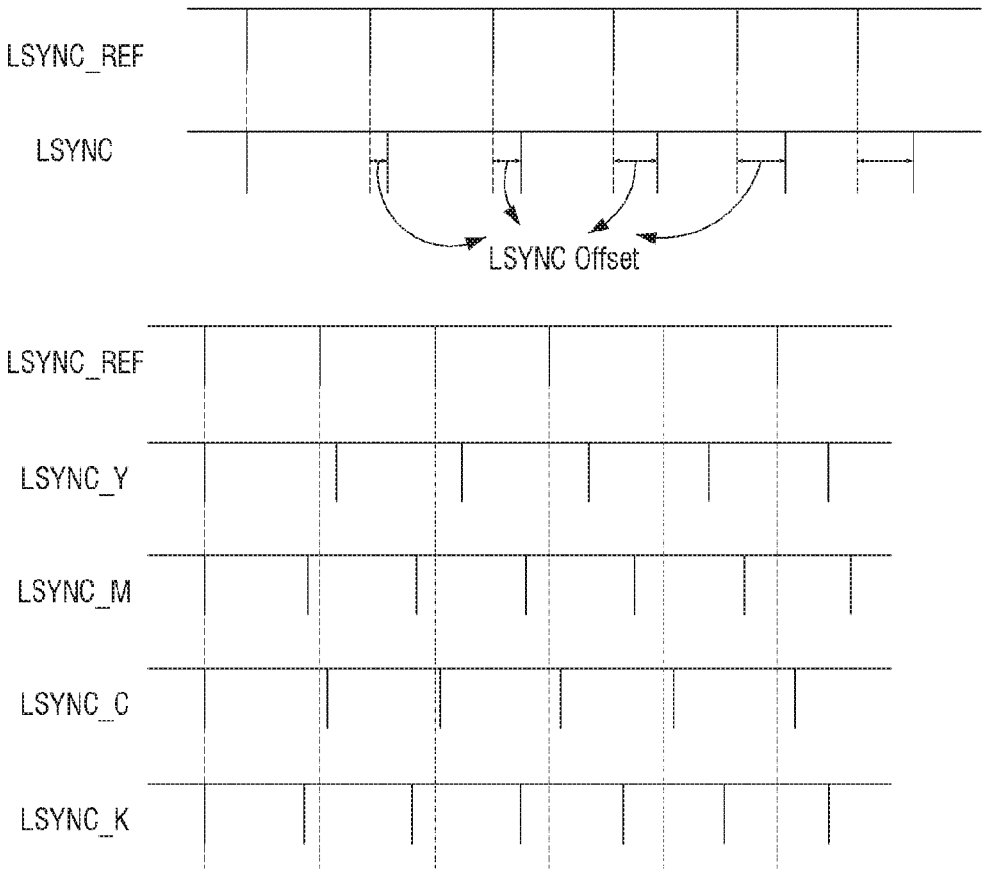
FIG. 18 is a view illustrating timing of a sync reference signal and of a line sync signal per color where offset has been applied.

FIG. 18 is a view illustrating a situation where the generation point of a line sync reference signal and the generation point of a line sync signal have been made different from each other by applying an offset. Furthermore, because each of the plurality of photosensitive drums has a different OPC AC value, a Y line sync signal (LSYNC-Y), M line sync signal (LSYNC-M), C line sync signal (LSYNC-C) and K line sync signal (LSYNC-K) where offset has been granted are generated at different timings from one another. In a case where OPC AC values of the plurality of photosensitive drums coincidentally coincide to one another, each line sync signal where offset has been granted will be generated at the same timing. However, because there is low possibility that OPC AC values of a plurality of photosensitive drums coincide with one another, it will be possible to determine whether or not the image forming apparatus 1000 is one where the present disclosure has been applied based on the generation timing of each line sync signal of each of the plurality of photosensitive drums being different from one another.

In the aforementioned image forming apparatus 1000, there is an effect of performing OPC AC compensation without a motor control. Furthermore, by utilizing the video interface that used to be used in conventional LSU image forming apparatuses, there is no need to add an additional parallel interface to the image forming apparatus that uses LPH. Especially, by adjusting the width and location of the print data realized as a video signal in multi bit transmission, there is an effect that the image forming apparatus 1000 doesn't need to increase a video clock frequency or expand a transmission line of the print data.

Figure 19:
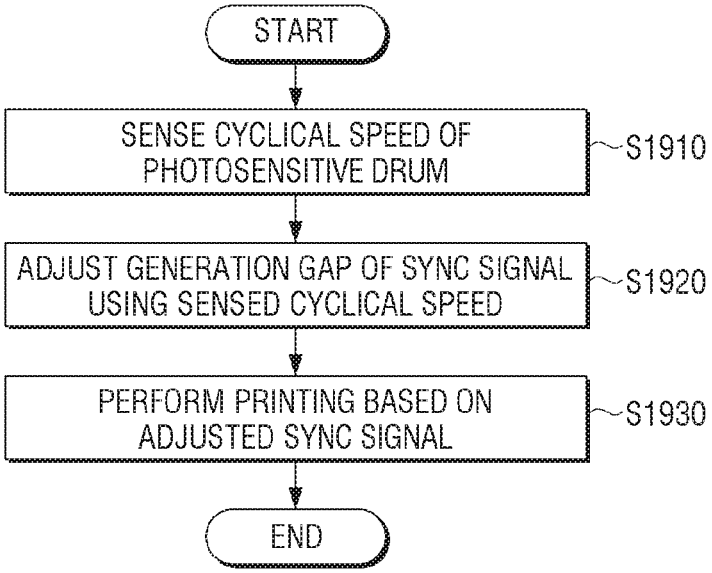
FIGS. 19 and 20 are flowcharts for explaining a method for controlling an image forming apparatus according to the present disclosure.

FIG. 19 is a flowchart for explaining a method for controlling an image forming apparatus according to an embodiment of the present disclosure 1000. The image forming apparatus 1000 senses a cyclical speed of a photosensitive drum (operation S1910). For example, the cyclical speed may be a flux or rotation speed of the photosensitive drum that is repeated at every cycle. The image forming apparatus 1000 adjusts a generation gap of a sync signal using the sensed cyclical speed of the photosensitive drum (operation S1920). The image forming apparatus 1000 may perform compensation of OPC AC by adjusting the generation gap of a sync signal instead of performing compensation of OPC AC by controlling the motor that drives the photosensitive drum. The image forming apparatus 1000 performs printing based on the adjusted sync signal (operation S1930). In the case of performing printing based on the adjusted sync signal, the OPC AC component is removed, and thus the image forming apparatus 1000 may output a print output intended by the user. In a case of a color image forming apparatus that uses LPH 1000, a generation gap of a sync signal must be adjusted for every color photosensitive drum. Because there is no need for a motor adjustment, the image forming apparatus 1000 may drive the plurality of photosensitive drums using one motor.

Figure 20:
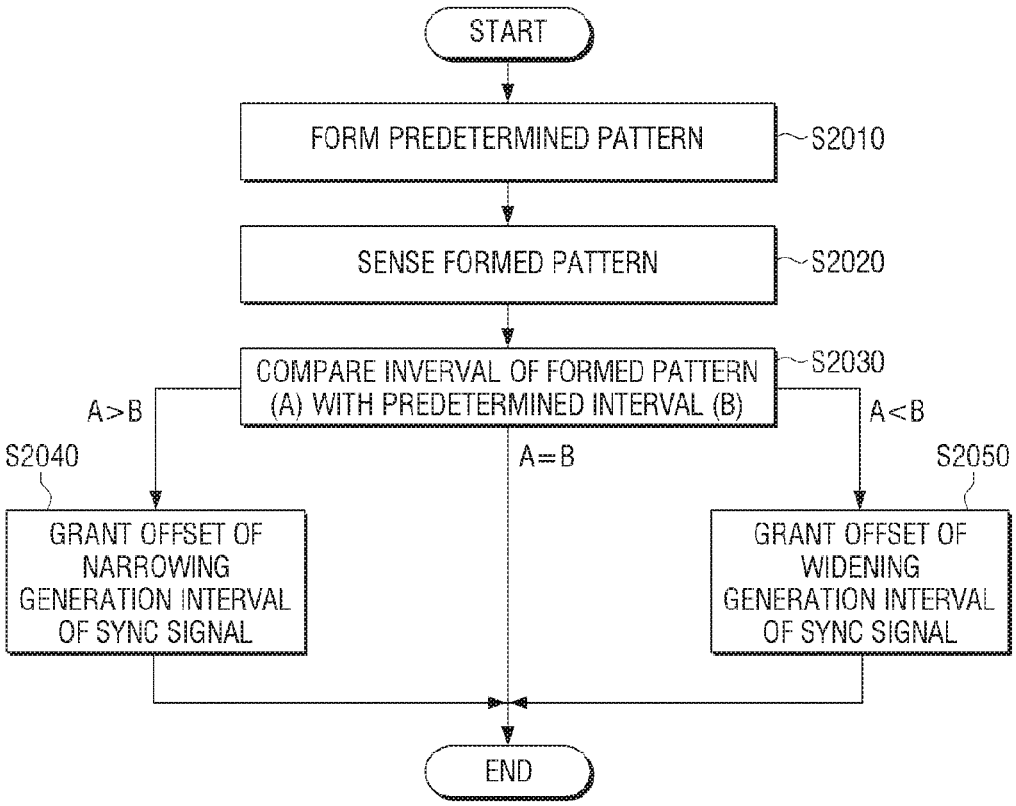

FIG. 20 is a flowchart for explaining a method for controlling an image forming apparatus according to an embodiment of the present disclosure 1000. The image forming apparatus 1000 forms a predetermined pattern on the image forming medium (operation S2010). The predetermined pattern may be pattern wherein line sync signals of equal gaps are used. The image forming apparatus 1000 senses the formed pattern (operation S2020). Because a location error occurs cyclically, the formed pattern will not be a pattern of equal gaps that was intended. The image forming apparatus 1000 compares a gap (A) of the pattern formed with a predetermined pattern (B) (operation S2030). The gap of the pattern formed being the same as the predetermined gap means OPC AC compensation is not necessary. If the gap of the pattern formed is wider than the predetermined pattern (A>B), the image forming apparatus 1000 grants an offset for narrowing the generation gap of the sync signal (operation S2040). On the contrary, if the gap of the pattern formed is narrower than the predetermined pattern (A<B), the image forming apparatus 1000 grants an offset for widening the generation gap of the sync signal (operation S2050). Various embodiments on the method for controlling the image forming apparatus 1000 are similar to the aforementioned embodiment of the image forming apparatus 1000, and thus repeated explanation will be omitted.

Furthermore, a program code for performing a controlling method according to the aforementioned various embodiments may be stored in various types of record media. More specifically, such a program code may be stored in various types of terminal-readable record media such as RAM (Random Access Memory), flash memory, ROM (Read Only Memory), EPROM (Erasable Programmable ROM), EEPROM (Electronically Erasable and Programmable ROM), register, hard disk, removable disk, memory card, USB memory, and CD-ROM and the like.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a photosensitive drum;

an LED Print Head (LPH) configured to emit light to the photosensitive drum based on a sync signal;

an image former configured to perform printing using the LPH;

a sensor configured to sense a cyclical speed of the photosensitive drum; and an LPH controller configured to adjust a generation gap of the sync signal using the sensed cyclical speed, wherein the LPH controller generates a line sync signal and page sync signal with the sync signal, and grants an offset only to the line sync signal, so that a timing of the page sync signal and a timing of the line sync signal do not match each other.

2. The apparatus according to claim 1, wherein the image former forms a predetermined pattern on an image forming medium, and the sensor senses the pattern formed on the image forming medium, and senses a cyclical speed of the photosensitive drum.

3. The apparatus according to claim 2, wherein the LPH controller checks a gap change of the photosensitive drum through the sensed pattern formed on the image forming medium, and adjusts the generation gap of the sync signal to compensate for the gap change.

4. The apparatus according to claim 3, wherein the LPH controller, in response to sensing that a gap of the formed pattern is narrower than a predetermined gap, adjusts the generation gap of the sync signal to be wider, and in response to sensing that a gap of the formed pattern is wider than the predetermined gap, adjusts the generation gap of the sync signal to be narrower.

5. An image forming apparatus comprising:

a plurality of photosensitive drums;

a plurality of LED Print Heads (LPHs) configured to emit light to each of the plurality of photosensitive drums based on a sync signal;

an image former configured to perform printing using the plurality of LPHs;

a sensor configured to sense a cyclical speed of each of the plurality of photosensitive drums; and a plurality of LPH controllers configured to respectively adjust a generation gap of each sync signal provided in the plurality of LPHs, wherein at least one of the plurality of LPH controllers generates a sync reference signal, and transmits the generated sync reference signal to the remaining LPH controllers, and the plurality of LPH controllers grant an offset to the sync reference signal to presume the sensed cyclical speed of each of the photosensitive drum to generate a sync signal where a generation gap has been adjusted.

6. The apparatus according to claim 5, wherein the sync signal for each of the plurality of photosensitive drums is a K line sync signal, a C line sync signal, a M line sync signal, and a Y line sync signal, and the K line sync signal, C line sync signal, M line sync signal, and Y line sync signal where the offset has been granted are generated at different timings to one another.

7. An image forming apparatus comprising:

a photosensitive drum;

an LED Print Head (LPH) configured to emit light to the photosensitive drum;

an LPH controller configured to control the LPH;

an image former configured to perform printing using the LPH; and a main controller configured to transmit a video signal of a single bit corresponding to received print data to the LPH controller;

wherein the LPH controller converts the received video signal of the single bit into a video signal of multi bit that is recognizable in the LPH.

8. The apparatus according to claim 7, wherein the main controller may adjust a pulse width and location of the video signal of a single bit, and transmit the video signal of the single bit to the LPH controller through a video interface.

9. The apparatus according to claim 8, wherein the LPH controller extracts data for calculating an amount of light of each LED that forms the LPH using the pulse width and location of the received video signal of the single bit.

10. A method comprising:

sensing a cyclical speed of a photosensitive drum of an image forming apparatus;

adjusting a generation gap of a sync signal based on the sensed cyclical speed; and performing printing using an LED Print Head (LPH) that emits light to the photosensitive drum based on the adjusted sync signal, wherein the adjusting involves generating a line sync signal and page sync signal with the sync signal, and granting an offset only to the line sync signal, so that a timing of the page sync signal and a timing of the line sync signal do not match each other.

11. The method according to claim 10, further comprising forming a predetermined pattern on an image forming medium, wherein the sensing involves sensing the pattern formed on the image forming medium, and sensing the cyclical speed of the photosensitive drum.

12. The method according to claim 11, wherein the adjusting checks a gap change of the photosensitive drum through the sensed pattern formed on the image forming medium, and adjusts the generation gap of the sync signal to compensate for the gap change.

13. The method according to claim 12, wherein the adjusting, in response to sensing that a gap of the formed pattern is narrower than a predetermined gap, adjusts the generation gap of the sync signal to be wider, and in response to sensing that a gap of the formed pattern is wider than the predetermined gap, adjusts the generation gap of the sync signal to be narrower.

14. A method comprising:

sensing a cyclical speed of a each of the plurality of photosensitive drums of an image forming apparatus;

generating a sync reference signal by at least one of a plurality of LPH controllers of the image forming apparatus;

transmitting the generated sync reference signal to the remaining plurality of LPH controllers;

adjusting a generation gap of each sync signal based on the sensed cyclical speed; and performing printing using an LED Print Head (LPH) that emits light to the plurality of photosensitive drums based on the adjusted sync signal, wherein the adjusting includes granting an offset to the sync reference signal to presume the sensed cyclical speed of each of the photosensitive drum to generate a sync signal where a generation gap has been adjusted.

15. The method according to claim 14, wherein the sync signal regarding each of the plurality of photosensitive drums is a K line sync signal, a C line sync signal, a M line sync signal, and a Y line sync signal, and the K line sync signal, C line sync signal, M line sync signal, and Y line sync signal where the offset has been granted are generated at different timings to one another.

* * * * *